United States Patent [19]

Hiramatu et al.

[11] 4,331,120

[45] May 25, 1982

[54] DEVICE FOR CONTROLLING EVAPORATIVE EMISSION FROM AN AUTOMOBILE

[75] Inventors: Eizi Hiramatu, Aichi; Yasushi Nakagawa; Hidenori Sato, both of Nagoya; Shigeru Yoshida, Aichi, all of Japan

[73] Assignees: Toyota Jidosha Kogyo Kabushiki Kaisha; Nippon Denso Kabushiki Kaisha; Aisan Industry Co. Ltd., all of Aichi, Japan

[21] Appl. No.: 57,643

[22] Filed: Jul. 16, 1979

[30] Foreign Application Priority Data

Oct. 31, 1978 [JP] Japan ..... 53-133143

[51] Int. Cl.[3] ..... F02M 37/02

[52] U.S. Cl. ..... 123/519; 251/359; 55/417; 123/520

[58] Field of Search ..... 123/519, 518, 520, 521; 251/359; 137/540, 512, 512.1; 55/417, 420, 387

[56] References Cited

U.S. PATENT DOCUMENTS

| | | | |
|---|---|---|---|
| 3,225,786 | 12/1965 | Elliot | 137/512 |
| 3,575,152 | 4/1971 | Wentworth | 123/136 |
| 3,683,597 | 8/1972 | Beveridge et al. | 55/316 |
| 3,967,808 | 7/1976 | Lieding | 251/359 |
| 4,167,200 | 9/1979 | Bouteille | 137/884 |
| 4,173,207 | 11/1978 | Hiramatsu | 123/136 |

*Primary Examiner*—Charles J. Myhre
*Assistant Examiner*—Carl Stuart Miller
*Attorney, Agent, or Firm*—Armstrong, Nikaido, Marmelstein & Kubovcik

[57] ABSTRACT

A device for controlling evaporative emission from an automobile, which device comprises, a casing accommodating fuel gas absorbing agents, a tank port adapted to communicate with a fuel tank of the automobile and having a first check valve for permitting the flow of fuel gas from the fuel tank into the casing, and a purge port adapted to communicate with an internal combustion engine and having a second check valve for permitting the flow of fuel gas from the casing to the engine. Each of the check valves of the first and second check valves comprises a check ball of metal, and a valve seat engaging with the check ball and being made of thin metal plate formed in one body with a reinforcement of plastic.

6 Claims, 6 Drawing Figures

DEVICE FOR CONTROLLING EVAPORATIVE EMISSION FROM AN AUTOMOBILE

BACKGROUND OF THE INVENTION

This invention relates to a device for controlling evaporative emission from an automobile.

If fuel evaporated from a fuel tank of an automobile and/or a combustible gas mixture preparing device, such as a carburetor, is emitted into the atmosphere, air pollution is caused due to hydrocarbons contained in the fuel. Devices are known which control evaporative emission so as to prevent air pollution due to the evaporated fuel and which prevent evaporative fuel loss from an automobile. For example, a device, described in Japanese Patent Publication No. 19729-78, for controlling the evaporative emission from a fuel tank communicated with an internal combustion engine comprises: a casing which accomodates fuel gas absorbing agents; a tank port which is disposed on the casing and which is adapted to communicate with the fuel tank, and which has two check valves in parallel therein for permitting the flow of fuel gas from the fuel tank into the casing and from the casing into the fuel tank , respectively, and; a purge port which is disposed on the casing and which is adapted to communicate with an internal combustion engine mounted in an automobile, and which has a check valve therein for permitting the flow of fuel gas from the casing to the engine. This device can control evaporative emission. This is because, when the pressures in the fuel tank and intake passage of the internal combustion engine become vacuums, some of the check valves are open so that evaporated fuel from the fuel tank and a float chamber of the carburetor is temporarily stored in the absorbing agents in the casing. Control can also be achieved because, when the engine is restarted, another check valve, which has been closed while the engine is stopped, is open due to the intake vacuum, so that fuel gas stored in the absorbing agents is purged and discharged into the intake passage of the engine, and then, the purged fuel gas is burnt in the combustion chambers of the engine. As a result, emission of hydrocarbons into the atmosphere and air pollution caused thereby are prevented.

However, if the device described in the above mentioned prior art is made entirely of a metal, such as steel plate or die cast aluminum, the weight of the device becomes very heavy, and the cost of the device becomes high since a number of manufacturing steps are needed. In addition, in the device, the tank port and the purge port have valve members mounted in the ports thereof for supplying vacuum. Since the valve members are separately constructed from the casing and are accomodated into the casing, the manufacturing cost of the valve members is also high.

To overcome the above mentioned problems attempts have been made to manufacture the device of plastic, so that the weight and the cost of the device would both be low. However, since the valve seats of the check valves of the device are also made of the plastic, the durability of the valve seat is not satisfactory, and therefore, the device cannot actually be utilized.

SUMMARY OF THE INVENTION

The principal object of the present invention is to provide a device for controlling evaporative emission from an automobile, which device includes a plurality of check valves comprising check balls and valve seats, wherein each of the valve seats is made in one body with a reinforcement of plastic so that the compactness and durability of the device is increased and the manufacturing cost of the device is decreased.

The present invention achieves the above-mentioned object by a device which comprises: a casing which accomodates fuel gas absorbing agents therein; a tank port which is disposed on the casing and which is adapted to communicate with a fuel tank of the automobile, and which has a first check valve therein for permitting the flow of fuel gas from the fuel tank into the casing, and; a purge port which is disposed on the casing and which is adapted to communicate with an internal combustion engine mounted in the automobile, and which has a second check valve therein for permitting the flow of fuel gas from the casing to the engine, wherein each of the first and second check valves comprises a check ball of metal, and a valve seat which engages with the check ball and which is made of thin metal plate formed in one body with a reinforcement of plastic.

DETAILED DESCRIPTION OF THE INVENTION

With reference to the accompanying drawings, some embodiments of the present invention will now be explained in detail.

Figure 1:
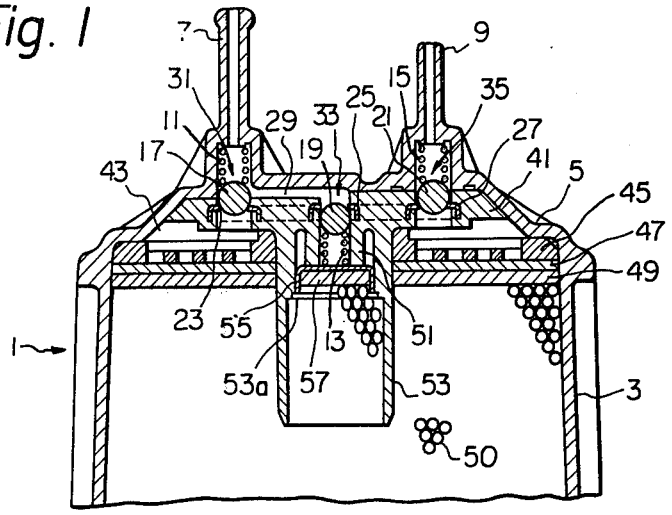
FIGS. 1 through 3 are cross sectioned elevational views which illustrate different embodiments of the present invention, respectively.

Referring to FIG. 1, which illustrates a first embodiment of the present invention, a canister 1 is constructed of a casing 3 and a cap 5 closing the top of the casing 3, the casing 3 and the cap 5 being made of plastic and formed in one body. The bottom of the canister 1 is closed by a bottom plate (not shown) which has an atmospheric air port (not shown but will be explained later with reference to FIGS. 3 through 5). The cap 5 has a tank port 7 which is adapted to communicate with a fuel tank (not shown) and a purge port 9 which is adapted to communicate with an intake passage of an internal combustion engine (not shown). Check valves 31 and 33 are disposed within the tank port 7 and comprise compression springs 11 and 13, check balls 17 and 19, which are urged by the compression springs 11 and 13 and which are made of hard metal, such as stainless steel, and valve seats 23 and 25, which cooperate with the check balls 17 and 19 and which are made of thin metal plate, such as stainless steel, respectively. The check valves 31 and 33 are communicated with each other through a passage 29. The check valve 31 is open when the pressure in the tank port 7 becomes a vacuum because the check ball 17 is sucked against the spring force of the compression spring 11 and away from the valve seat 23. The check valve 33 is open when the pressure in the tank port 7 becomes sufficiently high because the check ball 19 moves apart from the valve seat 25 against the spring force of the compression spring 13. Similarly, in the purge port 9, a check valve 35 comprising a compression spring 15, a check ball 21 and a valve seat 27 is disposed so that the check valve 35 is open when the pressure in the purge port 9 becomes a vacuum. The materials of the check ball 21 and the valve seat 27 are similar to those of the check valves 31 and 33.

The valve seats 23, 25 and 27 are formed on one or more thin stainless steel plates by forming small holes thereon, respectively, and then, the stainless steel plate or plates with small holes is insert molded with a reinforcement of plastic, such as nylon 66, which has a resistance against oil and is durable, so that a circular disk 41 is formed. The upper shoulder portion of the circular disk 41 is chamfered. The chamfered upper shoulder portion sealingly engages with the inner surface of the cap 5 forming a part of the canister 1. The upper portion of the circular disk 41, which faces the purge port 9, is bulged up in the shape of a small circle, and the upper shoulder portion of the small circle is also chamfered so that the chamfered shoulder portion sealingly engages with the inner surface of the cap 5. After the chamfered shoulder portions of the circular disk 41 and the small circle are in abutment with and ultrasonicly welded to the inner surface of the cap 5, the check valves 31, 33 and 35 are formed within the canister 1, while the tank port 7 is isolated from the purge port 9. It should be noted that the stainless steel plate forming valve seats of the check valves 31, 33 and 35 may be fixed on only one surface of the circular disk 41 if the plate is formed in one body with the circular disk 41.

A grid 45 is disposed at the shoulder of the cap via the circular disk 41 and a space 43. Then, a foam filter 47, made of such as urethane foam, and an unwoven filter 49, which is preferably a mixture of synthetic fibers, such as nylon or polyester and rayon, are disposed in the casing 3. Fuel gas absorbing agents 50, which are particles of activated charcoal, is accomodated within the casing 3. Two annular projections 51 and 53 coaxially extend from the circular disk 41 so that they surround the valve seat 25. A stainless steel plate 55, which supports the lower end of the compression spring 13, is disposed at the bottom of the inner annular projection 51. In the first embodiment illustrated in FIG. 1, the peripheral edge of the stainless steel plate 55 is folded, and the folded edge is engaged with an annular shoulder 53*a* formed within the projection 53. Filters 57, which are similar to the filters 47 and 49, are disposed beneath the stainless steel plate 55.

Figure 2:
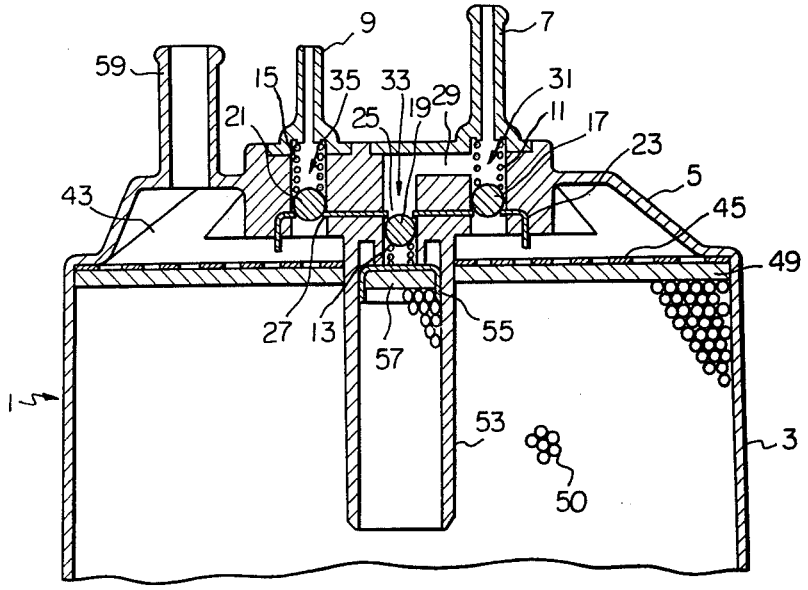
Figure 3:
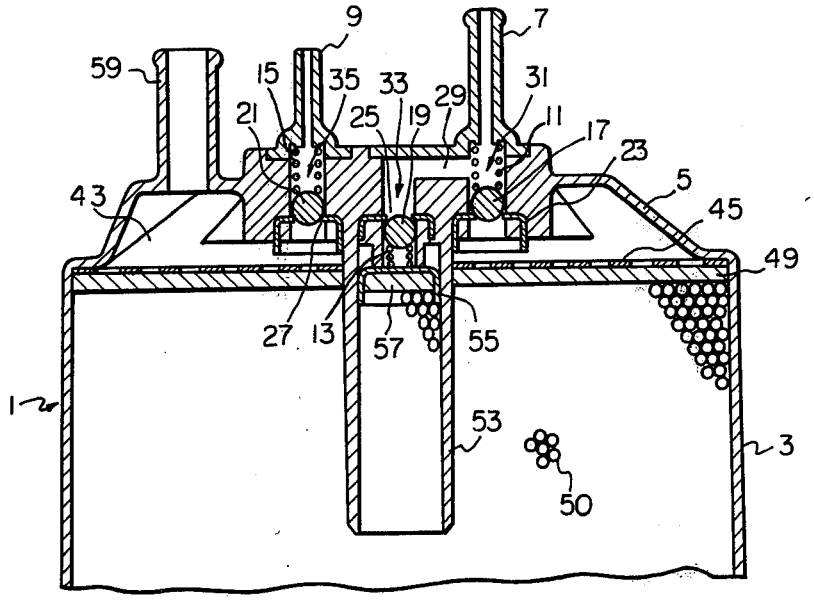

The second embodiment of the present invention will now be explained with reference to FIG. 2. Since the second embodiment is very similar to the first embodiment, the same reference numerals are used to indicate parts which are the same as those in the first embodiment, and the detailed explanation of those parts is omitted herein. It should be noted, that, in FIG. 2, the positions of the tank port 7 and the purge port 9 are reversed to those in FIG. 1. Although in the first embodiment, illustrated in FIG. 1, the circular disk 41 is connected to the inside of the cap 5 so that the circular disk 41 forms check valves 31, 33 and 35 together with the cap 3, in the second embodiment, illustrated in FIG. 2, the check valves 31, 33 and 35 are formed in one body with the cap 5 and the circular disk 41 (FIG. 1) is omitted. Otherwise the connectors of the tank port 7 and the purge port 9 are fixed to the cap, preferably by means of insert molding. The valve seats 23, 25 and 27 are formed by three holes pierced in one thin stainless steel plate similar to those of the first embodiment. In some cases, as illustrated in FIG. 3, the valve seats 23, 25 and 27 may be formed on three small thin stainless steel plates, respectively, and then, the three plates may be insert molded within the plastic reinforcement, such as the cap 5 or the circular disk 41 (this embodiment is not illustrated herein). In the second and third embodiments illustrated in FIGS. 2 and 3, the lower end of the stainless steel plate 55, which supports the compression spring 13 of the check valve 33, is folded. The folded end is press fitted within the projection 53. Furthermore, in the second embodiment the filter 47 is omitted and only the filter 49 is utilized. However, it should be noted that the material of the filters 47 and 49 can be altered, and the thickness thereof increased or reduced. An outer vent pot 59, which is not provided with any check valve, is communicated with the canister 1 in the second and third embodiments. The outer vent port 59 can be omitted from the second and third embodiments or may be also added to the first embodiment.

Figure 4:
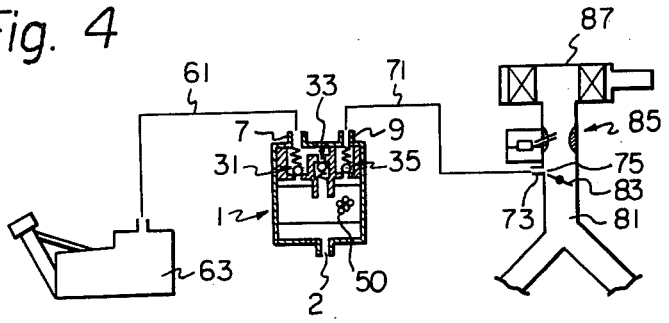
FIGS. 4 through 6 are partially cross sectioned elevational views which illustrate examples utilizing the present invention, respectively.

The operation of the device according to the present invention will now be explained. Referring to FIG. 4, the device of the first embodiment is utilized, and the canister 1, which has the tank port 7, the purge pot 9 and the atmospheric air port 2, is connected as follows. The tank port 7 is communicated with the fuel tank 63 via a pipe 61. The purge port 9 is communicated with an intake vacuum port 75, which is located adjacent to a throttle valve 83 in an intake pipe 81 for supplying a combustible gas mixture into an internal combustion engine (not shown), via a pipe 71 and an orifice 73. The entrance of the intake pipe 81 is communicated with an air cleaner 87 via a carburetor 85, and the lower end of the intake pipe is communicated with the combustion chambers of the engine (not shown).

When the pressure within the fuel tank 63 is increased due to the evaporation of the fuel while the automobile is driven, the pressure is transmitted to the tank port 7 through the pipe 61. Then, the check valve 33, which is the first valve of the present invention, is opened and the flow of fuel gas from the fuel tank 63 into the casing of the canister 1 is permitted. Contaminants, especially hydrocarbons, contained in the fuel gas are absorbed by the fuel gas absorbing agents 50, and the filtered and cleaned air is discharged from the atmospheric air port 2 into the atmosphere. As a result, the fuel gas does not cause air pollution.

The intake vacuum, which is generated while the engine is driven, is transmitted to the purge port 9 through the intake vacuum port 75. Then, the check valve 33, which is the second check valve of the present invention, is opened. As a result, the air introduced through the atmospheric air port 2 purges the fuel contaminants, which have been absorbed by the fuel absorbing agents 50, and transports them to the intake pipe 81 through the purge port 9. The purged fuel contaminants are burnt in the combustion chambers of the engine (not shown) with the combustible gas mixture. Therefore, air pollution caused by evaporated fuel can be prevented.

In addition, in this embodiment, when the pressure within the fuel tank 63 becomes a vacuum after the engine is stopped, the check valve 31, which is the third check valve of the present invention, is opened. Then, the fuel contaminants absorbed by the fuel absorbing agents 50 in the casing 3 of the canister 1 are returned to the fuel tank 63 through the pipe 61. As a result, the evaporative fuel loss is reduced.

Figure 5:
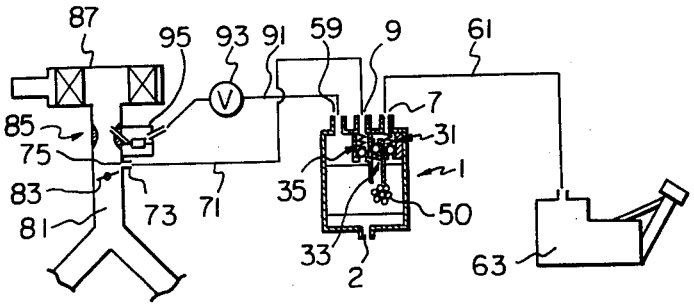

In FIG. 5, an example utilizing the second embodiment of the present invention is illustrated. In this example, the connection of the pipes is the same as that illustrated in FIG. 4, except that the outer vent 59 is communicated with a float chamber 95 of the carburetor 85 via a pipe 91 and a switch valve 93, and the parts which are the same as those illustrated in FIG. 4 operate in a similar manner to that explained with reference to FIG. 4. The switch valve 93 is open while the engine is operated. When the switch valve 93 is open, the fuel gas evaporated from the float chamber 95 is absorbed by the fuel gas absorbing agents 50 in the canister 1. As a result, air pollution caused by the fuel gas being discharged into the atmosphere can be prevented.

Figure 6:
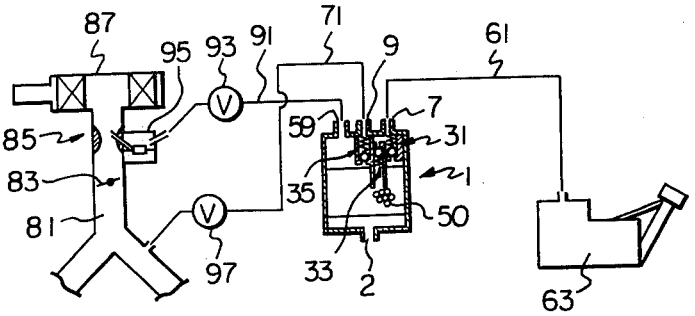

The example illustrated in FIG. 6 has the same construction and operates in the same manner as that illustrated in FIG. 5, except that a pipe 71 communicated with the purge port 9 is communicated with the intake pipe 81 located downstream of the throttle valve 83 via the purge control valve 97.

The device according to the present invention utilizes check valves which comprise check balls, compression springs and valve seats, and which are operated by the pressure in a fuel tank and the purge pressure of an engine. Since the device can control the flow of fuel gas thereto and therefrom through pipes for transmitting control signals to the check valves, the construction of the canister can be simple and the size of the canister can be compact. In the device according to the present invention, each of the valve seats of the check valves is formed on a thin metal plate, and the thin metal plate is formed in one body with a reinforcement of plastic. As a result, the valve seats of the device according to the present invention are lighter and more compact than the valve seats made entirely of metal, and they have more durability when they are in abutment with the check balls than the valve seats made entirely of plastic. Furthermore, the valve seats of the present invention have more strength than the valve seats made of only thin metal plates.

What we claim is:

1. Device for controlling evaporative emission from an automobile which device comprises:

a casing which accommodates fuel gas absorbing agents therein;

a tank port which is disposed on said casing and which is adapted to communicate with a fuel tank of said automobile, and which has a first check valve therein for permitting flow of fuel gas from said fuel tank into said casing, and;

a purge port which is disposed on said casing and which is adapted to communicate with an internal combustion engine mounted on said automobile, and which has a second check valve therein for permitting flow of fuel gas from said casing to said engine, wherein each of said check valves of said first and second check valves comprises:

a plastic body, a thin metal plate insert-molded in said plastic body, said body having a bore therethrough having an axis and a diameter, the metal plate having a hole therethrough having an edge, a center and a diameter, the center of the hole being aligned on the axis of the bore and the diameter of the hole being less than the diameter of the bore, thereby centering the edge within the bore, and a metal check ball disposed in the bore having a diameter greater than the diameter of the hole and less than the diameter of the bore, the ball engaging the edge of the hole as a valve seat.

2. Device according to claim 1 which further comprises a third check valve disposed in said tank port in parallel with said first check valve, said third check valve also comprising:

a plastic body, a thin metal plate insert-molded in said plastic body, said body having a bore therethrough having an axis and a diameter, the metal plate having a hole therethrough having an edge, a center and a diameter, the center of the hole being aligned on the axis of the bore and the diameter of the hole being less than the diameter of the bore, thereby centering the edge within the bore, and a metal check ball disposed in the bore having a diameter greater than the diameter of the hole and less than the diameter of the bore, the ball engaging the edge of the hole as a valve seat so that said third valve permits the flow of fuel gas from said casing into said fuel tank.

3. Device according to claim 1 or 2 wherein said check valves are formed of a single thin metal plate in a single plastic body.

4. Device according to claim 1 or 2 wherein said valve seats of said check valves are formed on corresponding thin metal plates, respectively, and said thin metal plates are formed in one body in a single plastic body.

5. Device according to claim 1 or 2, which further comprises a cap for closing the top of said casing, and said plastic body is in abutment with and sealingly connected to said cap.

6. Device according to claim 1 or 2, which further comprises a cap for closing the top of said casing, said cap constituting said plastic body.

* * * * *